US006356029B1

(12) United States Patent
Hunter

(10) Patent No.: US 6,356,029 B1
(45) Date of Patent: Mar. 12, 2002

(54) ACTIVE MATRIX ELECTROLUMINESCENT DISPLAY DEVICE

(75) Inventor: Iain M. Hunter, Brighton (GB)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/677,803

(22) Filed: Oct. 2, 2000

(30) Foreign Application Priority Data

Oct. 2, 1999 (GB) ..... 9923261

(51) Int. Cl.[7] ..... G09G 3/10

(52) U.S. Cl. ..... 315/169.1; 315/169.3; 315/224; 315/291; 345/76; 345/92; 345/214

(58) Field of Search ..... 315/169.3, 169.1, 315/169.2, 224, 291; 345/76, 36, 45, 92, 204, 214

(56) References Cited

U.S. PATENT DOCUMENTS 5,652,600 A * 7/1997 Khormaei et al. ..... 345/76
6,072,450 A * 6/2000 Yamada et al. ..... 345/76
6,144,165 A * 11/2000 Liedenbaum ..... 315/169.3

FOREIGN PATENT DOCUMENTS

| | | |
|---|---|---|
| EP | 0653741 A1 | 5/1995 |
| EP | 0717446 A2 | 6/1996 |
| EP | 0923067 A1 | 3/1998 |
| WO | WO9636959 | 11/1996 |
| WO | WO9938148 | 7/1999 |
| WO | WO9965012 | 12/1999 |

OTHER PUBLICATIONS

U.S. application No. 09/329,029, filed Jun. 9, 1999.

* cited by examiner

*Primary Examiner*—Haissa Philogene

(57) ABSTRACT

In an active matrix electroluminescent display device the drive current through an EL display element (20) in each pixel (10) in a drive period is controlled by a driving device (22) based on a drive signal applied to the pixel in preceding address period and stored as a voltage on an associated storage capacitor (36). In order to counteract the effects of display element ageing through which the light output of an element for a given drive signal level diminishes over time, the pixel includes a feedback circuit (40, 45, 47, 48) which is responsive to the potential difference across the display element in an initial part of the drive period indicative of the extent of ageing and which is arranged to adjust the voltage stored on the storage capacitance accordingly.

5 Claims, 4 Drawing Sheets

ACTIVE MATRIX ELECTROLUMINESCENT DISPLAY DEVICE

FIELD OF THE INVENTION

This invention relates to active matrix electroluminescent display devices comprising an array of electroluminescent display pixels.

BACKGROUND OF THE INVENTION

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of an electroluminescent material, for example a semiconducting conjugated polymer, sandwiched between a pair of electrodes, one of which is transparent and the other of which is of a material suitable for injecting holes or electrons into the polymer layer. The polymer material can be fabricated using a CVD process, or simply by a spin coating technique using a solution of a soluble conjugated polymer.

Organic electroluminescent materials exhibit diode-like I-V properties, so that they are capable of providing both a display function and a switching function, and can therefore be used in passive type displays.

However, the invention is concerned with active matrix display devices, with each pixel comprising an electroluminescent (EL) display element and a switching device for controlling the current through the display elements. Examples of an active matrix electroluminescent display are described in EP-A-0653741 and EP-A-0717446. Unlike active matrix liquid crystal display devices in which the display elements are capacitive and therefore take virtually no current and allow a drive signal voltage to be stored on the capacitance for the whole frame period, the electroluminescent display elements need to continuously pass current to generate light. A driving device of a pixel, usually comprising a TFT (thin film transistor), is responsible for controlling the current through the display element. The brightness of the display element is dependent on the current flowing through it. During an address period for a pixel, a drive (data) signal determining the required output from the display element is applied to the pixel and stored on a storage capacitor which is connected to, and controls the operation of, the current controlling drive device with the voltage stored on the capacitor serving to maintain operation of the switching device in supplying current through the display element during the period, corresponding to a frame period, until the pixel is addressed again.

A problem with known organic electroluminescent materials, particularly polymer materials, is that they exhibit poor stability and suffer ageing effects whereby the light output for a given driven current is reduced over a period of time of operation. While in certain applications such ageing effects may not be critical, the consequences in a pixellated display can be serious as any slight variations in light output from pixels can easily be perceived by a viewer.

SUMMARY OF THE INVENTION

It is an object of the present invention to provide an active matrix electroluminescent display device in which this problem is overcome at least to an extent.

According to the present invention there is provided an active matrix electroluminescent display device comprising an array of display pixels each comprising an electroluminescent display element and a driving device for controlling the current through the display element in a drive period based on a drive signal applied to the pixel during an address period preceding the drive period and stored as a voltage on a storage capacitance connected to the driving device, which is characterised in that each pixel includes feedback adjustment means responsive to the potential difference across the display element in the drive period and arranged to adjust the voltage stored on the capacitance in the address period in accordance therewith.

It has been recognised that as the EL display element degrades over time its impedance increases and the potential difference between its anode and cathode increases. The value of the change in potential difference provides a reasonable indication of the state of the element in terms of its light emission/drive current characteristics. Thus, by adjusting the signal voltage stored on the storage capacitance, which determines the display element drive current following addressing, according to the potential difference across the display element which is indicative of the light output characteristic of the display element and provides effectively a positive feedback variable, appropriate compensation for the effects of ageing of the display elements can be made in the driving of the element so that a desired light output level for a given applied drive signal is maintained regardless of possible variations in the drive current level/light output level characteristics of individual display elements in the array.

Although the invention is particularly beneficial in devices whose display elements are polymer LED materials, it can of course be applied to advantage in any electroluminescent device in which the electroluminescent material similarly suffers ageing effects resulting in a lowering of light output levels for a given drive current over a period of time of operation.

A switching device is preferably included in the feedback adjustment means that is operable to prevent current flowing through the display element in the address period and allow current to pass therethrough in the subsequent drive period. This switching device ensures that the potential across the display element at the end of the address period and at the beginning of the drive period is at a known level, i.e. 0 volts, and that the drive signal storage on the storage capacitance is not affected by any drive currents which might otherwise flow through the display element at this time.

In a preferred embodiment, the feedback adjustment means is responsive to the transient potential difference increase across the display element at the beginning of the drive period. Conveniently, a high pass filter circuit connected to the display element and responsive to the rise in voltage thereacross to provide an output in accordance therewith and which controls adjustment of the stored voltage may be used for this purpose. This circuit may include a further switching device operable by the output to connect a source of predetermined potential to the storage capacitance to provide supplemental charging.

BRIEF DESCRIPTION OF THE DRAWINGS

An embodiment of an active matrix electroluminescent display device in accordance with the present invention will now be described, by way of example, with reference to the accompanying drawings, in which.

The Figures are merely schematic. The same reference numbers are used throughout the Figures to denote the same or similar parts.

DETAILED DESCRIPTION OF THE PREFERRED EMBODIMENT

Figure 1:
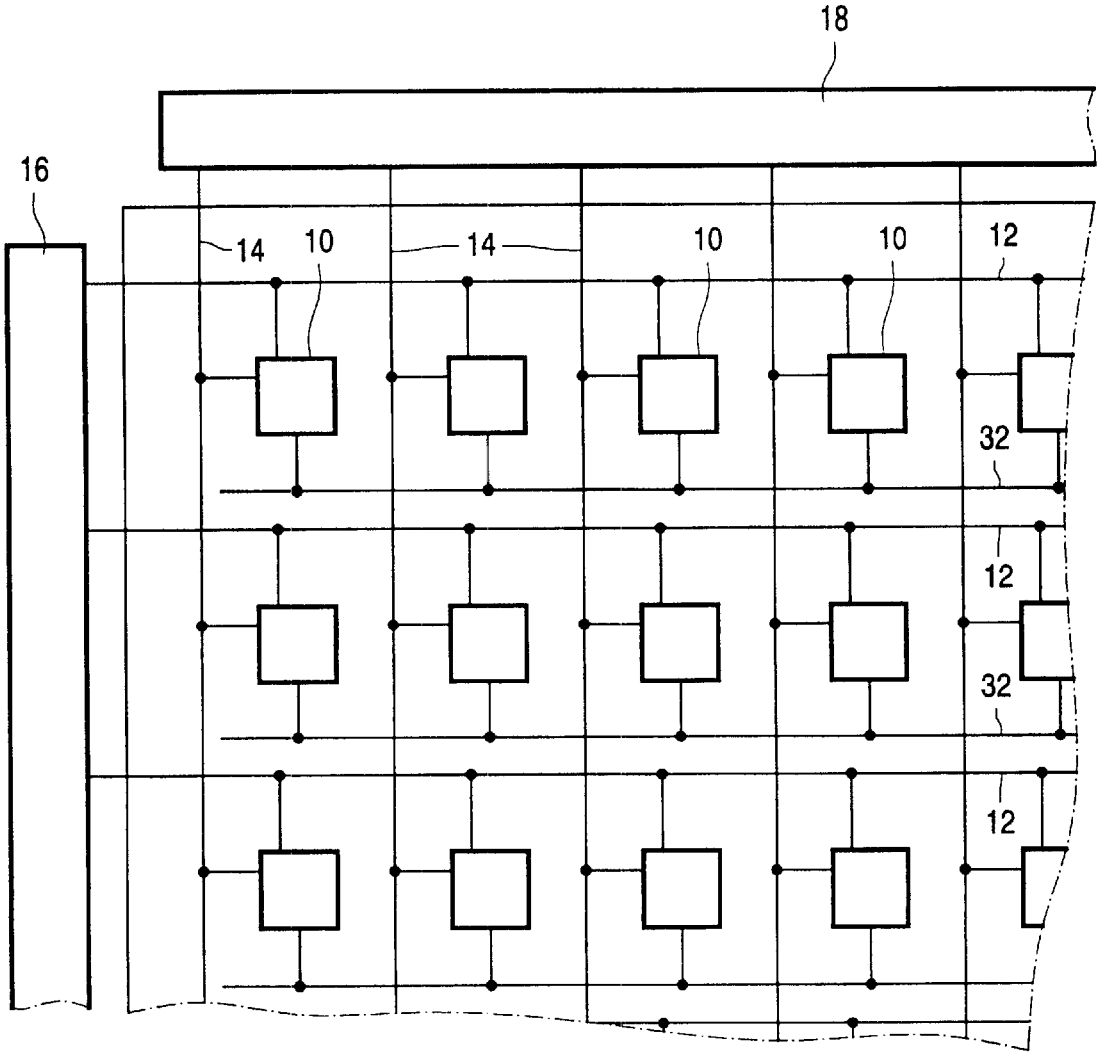
FIG.1 is a simplified schematic diagram of a known active matrix electroluminescent display device comprising an array of pixels.

Referring to FIG. 1, the active matrix electroluminescent display device comprises a panel having a row and column matrix array of regularly-spaced pixels, denoted by the blocks 10, each comprising an electroluminescent display element and an associated driving device controlling the current through the display element, and which are located at the intersections between crossing sets of row (selection) and column (data) address conductors, or lines, 12 and 14. Only a few pixels are shown for simplicity. The pixels 10 are addressed via the sets of address conductors by a peripheral drive circuit comprising a row, scanning, driver circuit 16 generating scanning signals supplied to the row conductors in sequence and a column, data, driver circuit 18 generating data signals supplied to the column conductors and defining the display outputs from the individual pixel display elements.

Each row of pixels is addressed in turn in a respective row address period by means of a selection signal applied by the circuit 16 to the relevant row conductor 12 so as to load the pixels of the row with respective drive signals according to the respective data signals supplied in parallel by the circuit 18 to the column conductors. As each row is addressed, the appropriate data signals are supplied by the circuit 18 in appropriate synchronisation.

Figure 2:
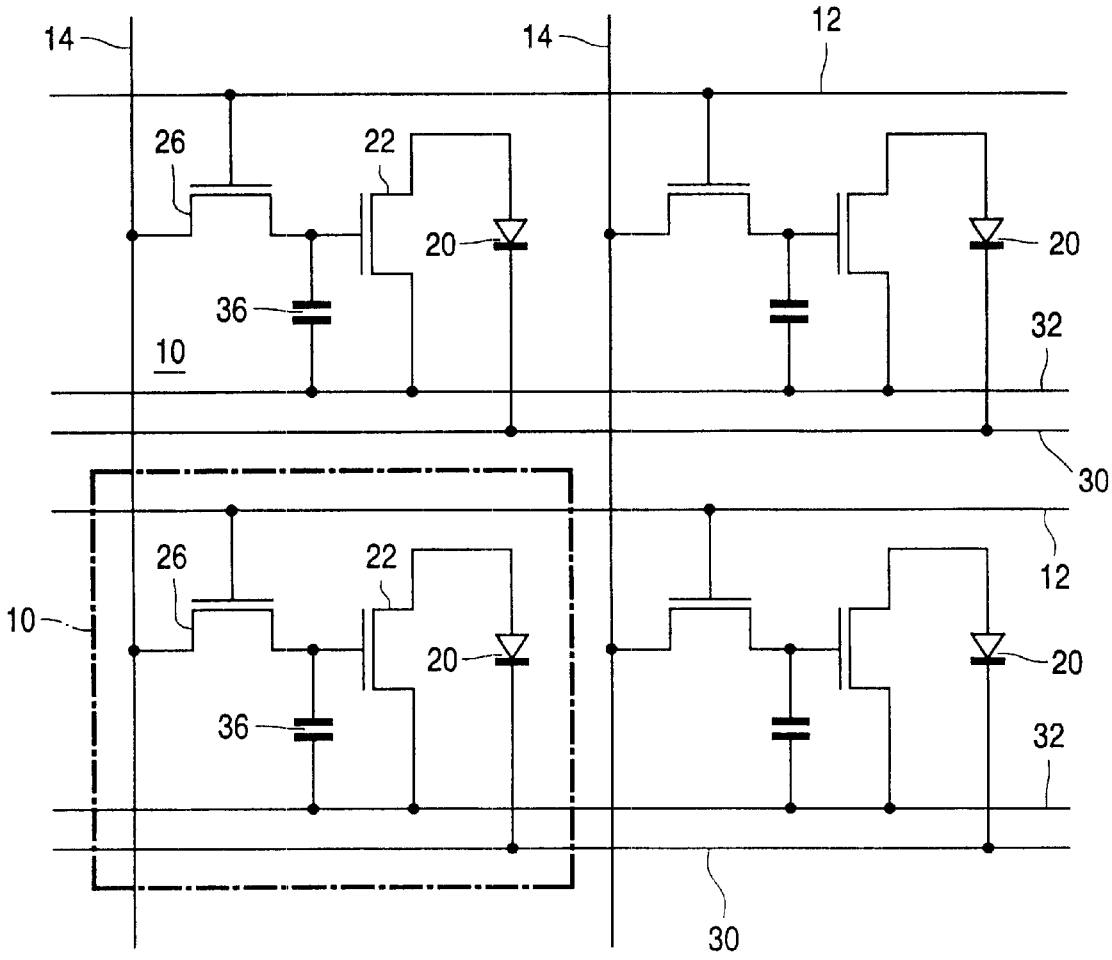
FIG. 2 shows the equivalent circuit of a few typical pixels of the active matrix electroluminescent display device of FIG. 1.

FIG. 2 illustrates the circuit of a few, typical, pixels in this known device. Each pixel, 10, includes a light emitting organic electroluminescent display element 20, represented here as a diode element (LED), and comprising a pair of electrodes between which one or more active layers of organic electroluminescent material is sandwiched. In this particular embodiment the material comprises a polymer LED material, although other organic electroluminescent materials, such as so-called low molecular weight materials, could be used. The display elements of the array are carried together with the associated active matrix circuitry on one side of an insulating support. Either the cathodes or the anodes of the display elements are formed of transparent conductive material. The support is of transparent material such as glass and the electrodes of the individual display elements 20 closest to the substrate can consist of a transparent conductive material such as ITO so that light generated by the electroluminescent layer is transmitted through these electrodes and the support so as to be visible to a viewer at the other side of the support. Alternatively, the light output could be viewed from above the panel and the display element anodes in this case would comprise parts of a continuous ITO layer constituting a supply line common to all display elements in the array. The cathodes of the display elements comprise a metal having a low work-function such as calcium or magnesium silver alloy. Examples of suitable organic conjugated polymer materials which can be used are described in WO 96/36959. Examples of other, low molecular weight, organic materials are described in EP-A-0717446.

Each pixel 10 includes a drive device in the form of a TFT 22 which controls the current through, and hence operation of, the display element 20 based on a data signal voltage applied to the pixel. The signal voltage for a pixel is supplied via a column conductor 14 which is shared between a respective column of pixels. The column conductor 14 is coupled to the gate of the current-controlling drive transistor 22 through an address TFT 26. The gates for the address TFTs 26 of a row of pixels are coupled together to a common row conductor 12.

Each row of pixels 10 also shares a common voltage supply line 30, usually provided as a continuous electrode common to all pixels, and a respective common current line 32. The display element 20 and the drive device 22 are connected in series between the voltage supply line 30 and the common current line 32, which is at a positive potential with respect to the supply line 30 and acts as a current drain for the current flowing through the display element 20. The current flowing through the display element 20 is controlled by the switching device 22 and is a function of the gate voltage on the transistor 22, which is dependent upon a stored control signal determined by the data signal supplied to the column conductor 14.

A row of pixels is selected and addressed in a respective row address period by the row driver circuit 16 applying a selection pulse to the row conductor 12 which switches on the address TFTs 26 for the respective row of pixels. A voltage level derived from the supplied video information is applied to the column conductor 14 by the driver circuit 18 and is transferred by the address TFT 26 to the gate of the drive transistor 22. During the periods when a row of pixels is not being addressed via the row conductor 12 the address transistor 26 is turned off, but the voltage on the gate of the drive transistor 22 is maintained by a pixel storage capacitor 36 which is connected between the gate of the drive transistor 22 and the common current line 32. The voltage between the gate of the drive transistor 22 and the common current line 32 determines the current passing through the display element 20 of the pixel 10 in the drive period immediately following the address period. Thus, the current flowing through the display element is a function of the gate-source voltage of the drive transistor 22 (the source of the transistor 22 being connected to the common current line 32, and the drain of the transistor 22 being connected to the display element 20). This current in turn controls the light output level (grey-scale) of the pixel.

The switching transistor 22 is arranged to operate in saturation, so that the gate-source voltage governs the current flowing through the transistor, irrespectively of the drain-source voltage. Consequently, slight variations of the drain voltage do not affect the current flowing through the display element 20. The voltage on the voltage supply line 30 is therefore not critical to the correct operation of the pixels.

Each row of pixels is addressed in turn in respective row address periods so as to load the pixels of each row in sequence with their drive signals and set the pixels to provide desired outputs for the drive (frame) period until they are next addressed.

With this known pixel circuit, it will be appreciated that the voltage stored on the capacitor 36 is substantially determined by the applied data signal voltage and that as this voltage in turn controls the drive transistor 22, and thus the current through the display element 20, the resulting light output level of the display element at any time will be dependent on the then existing current/light output level characteristic of the display element. The electroluminescent material of the display element can suffer degradation over a period time of operation leading to ageing effects which result in a reduction of the light output level for a given drive current level. Those pixels which have, therefore, been driven longer (or harder) will exhibit reduced brightness and cause display non-uniformities. With polymer LED materials the effects of such ageing can be significant.

Figure 3:
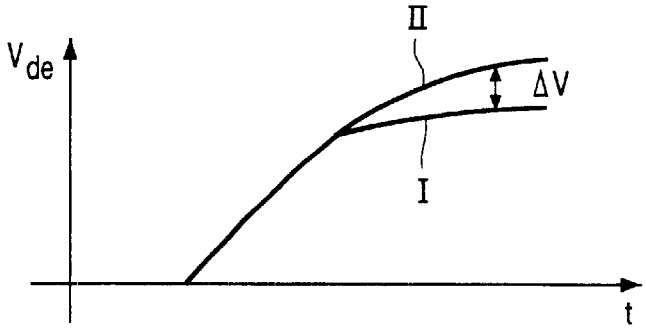
FIGS. 3 and 4 illustrate graphically the effects of ageing in the characteristics of a display element.

It has been found that as a display element conducting a given current degrades its impedance, and the potential difference across its anode and cathode, increases. The display element 20 has an inherent capacitance. FIG. 3 shows graphically the general effect of ageing of a display element, in terms of the voltage, $V_{de}$, across the display element against time, t, in its charging period when turned on both initially, curve I, and after, say, a few thousand hours operation, curve II. As is apparent, this voltage increases by an amount $\Delta V$, which amount varies according to the extent of ageing. Generally, $\Delta V$ increases with increasing age.

Figure 4:
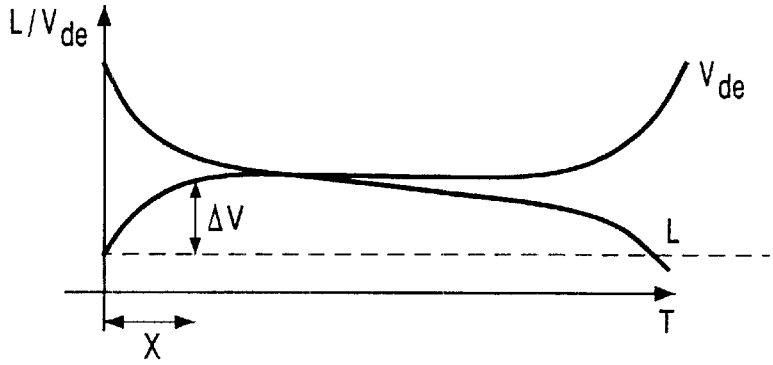

FIG. 4 shows graphically the relationship between the luminance, L, of a display element and the voltage, $V_{de}$, across a display element for a fixed drive current over an extended period of operating time, T, say a few thousand hours. As can be seen, the voltage during the early stages of the display element's operating lifetime increases significantly until reaching a plateau where it remains reasonably constant for a relatively long period before then increasing towards the end of the display element's life. Conversely, the variation in luminance is such that at the initial stages of the display element's life it drops significantly before reaching a reasonably constant level for a lengthy period and then falling again.

In the present invention, means are provided in each pixel to sense the potential difference across the display element and utilise its value as a feedback variable to adjust automatically the driving of the display element so as to compensate at least to some extent for such ageing effects, thereby tending to maintain the required light output level of the display element for any given data signal level.

Figure 5:
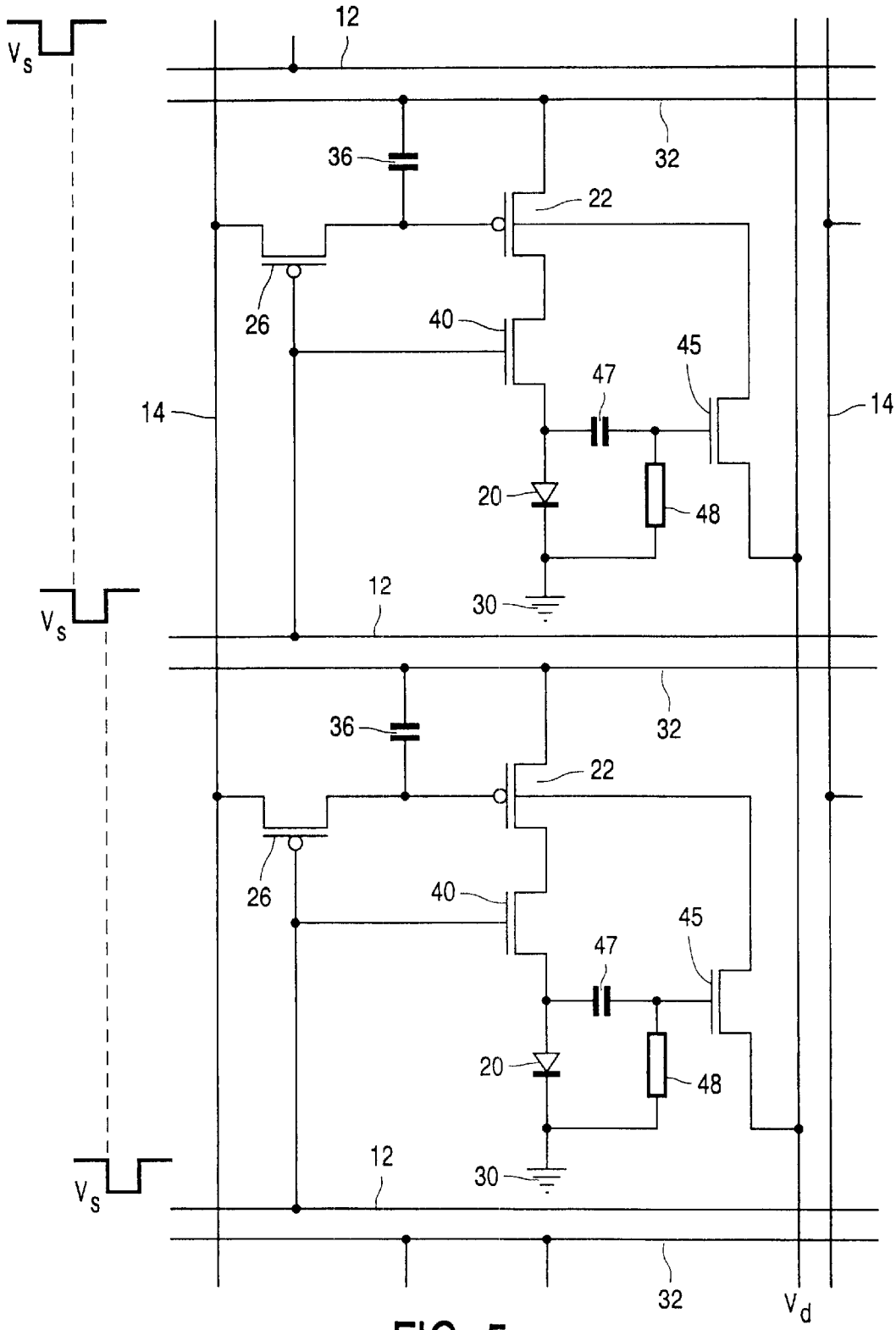
FIG. 5 shows the equivalent circuit of a few typical pixels in an embodiment of active matrix electroluminescent display device according to the invention.

Referring to FIG. 5, there is shown the equivalent circuit of a representative pixel in an embodiment of display device according to the invention and intended to overcome, at least to some extent, the light output reduction effects of ageing. In each pixel 10 the display element 20 is again connected in series with the drive transistor 22 between a current line 32 and a voltage supply line 30, here shown constituted by a common electrode layer shared by all the pixels. The gate and source of address transistor 26 are connected to the associated row and column conductors 12 and 14 respectively. Also the storage capacitor 36 is again connected across the node between gate of the drive transistor 22 and the drain of the transistor 26 and the current line 32.

The pixel also includes a further switch device 40, similarly in the form of a TFT, which is connected in series between the display element 20 and the control TFT 22 and whose gate is connected to the row conductor 12. Another TFT, a feedback TFT 45, is provided whose current carrying terminals are connected between the gate of the drive TFT 22 and a potential source Vd at a predetermined, low, level for example corresponding to the cathode potential. The gate of the TFT 45 is connected via a capacitor 47 to the junction between the display element's anode and the TFT 40, and also via a resistance 48 to the display element cathode voltage supply line 30. The resistance 48 and capacitor 47 together constitute a passive high pass filter circuit, acting as a passive differentiator, whose output is applied to the gate of the feedback TFT 45.

The TFTs 26 and 22 are both p-type TFTs while the TFTs 40 and 45 are n-type.

As before, the operation of the pixels has two phases, an addressing phase during which they are set to provide a desired display output according to an applied data signal and a subsequent drive phase in which their display elements are driven to produce a required display output until they are again addressed, for example in the following frame period. Typically, the row address period may be around 30 microseconds and the drive (frame) period around 16 milliseconds. In the addressing phase, the voltage on the relevant row conductor is taken low by means of a selection signal Vs generated by the row driver circuit 16 for a period corresponding to the row address period which turns on the p-type address TFT 26 allowing a data voltage provided by the column drive circuit 18 on the column conductor 14 to be stored on the pixel storage capacitor 36 and turning on the TFT 22. During this selection period, the n-type TFT 40 is held off so that no current can flow through the display element 20 at this time. In order to vary the light output from an individual pixel in a frame period, (i.e. its grey-scale) the charge placed on the gate node of the TFT 22 during the addressing period is adjusted appropriately by increasing the applied data signal voltage level.

At the end of the row address period, corresponding to the termination of the selection signal Vs, the voltage on the row conductor 12 returns to a high level, causing TFT 26 to turn off, thereby isolating the one terminal of the capacitor 36 from the column conductor 14. At the same time the TFT 40 is turned on. Drive current is then able to flow through the display element 20 via the series TFTs 22 and 40 with the level of the current being determined by the TFT 22 according to the voltage stored across the capacitor 36.

At the end of the row address period, the potential across the display element 20 is zero volts. Immediately thereafter, with the TFTs 22 and 40 conducting, the potential across the display element 20 starts to increase as it charges up and begins to conduct. The charging period occupies only a relatively small initial part of the drive period, typically 10 to 20 microseconds. The increasing potential across the display element in this initial period leads to the high pass filter constituted by the capacitance 47 and the resistance 48 providing a transient gate-source voltage to the feedback TFT 45 causing the TFT 45 to turn on and conduct, and thereby producing a transient charging of the storage capacitor 36 through the connection between its drain and the node between the gate of the TFT 22 and the capacitor 36. The resultant, relatively small, supplemental charging of the capacitor 36 dependent on the sensed voltage across the display element at this initial stage of the drive period is effective in controlling the drive TFT 22 to correspondingly increase slightly the current flowing through the display element 20. The amount of supplemental charging varies in accordance with the level of the sensed potential difference across the display element, and typically will be less than 10% or so of the overall stored charge.

As the display element degrades over time, the conducting voltage across it increases and as a result the supplementary charging of the capacitor 36 via the high pass filter and the feedback TFT 45 will increase correspondingly thereby providing some compensation for this ageing effect by appropriately controlling the drive TFT 22 to increase the level of drive current passed through the display element by the TFT 22. As a consequence, the significance of display element degradation on the data signal voltage—light emission characteristics of the pixel circuit are reduced and the amount of light generated by the display element for a given applied data signal in the drive phase will tend to be maintained at the desired level.

To achieve this objective, it is important for the feedback circuit to be correctly tuned. Adjustments can be made in this respect by varying the value of the predetermined potential Vd accordingly. The output of the R-C high pass filter 47, 48 controlling the operation of the TFT 45 is effectively a differential of the display element anode voltage. The high pass filter, 47 and 48, is tuned to the voltage rise time characteristic of the EL display element under constant current. Preferably, the circuit is tuned (by appropriate selection of its component values) such that the voltage output of the filter circuit follows the anode voltage of the display element during the charging period. The predetermined potential Vd may be ground, or at the display element cathode potential if this is other than ground, or possibly some different value, provided that it is such as to result in the TFT 45 being turned on when required. This potential Vd is common to all pixels and may conveniently be supplied to each pixel by means of a conductive grid pattern formed in the pixel array.

The feedback operation of the pixel circuit is most effective in the initial lifetime regime of the display element ageing characteristic, i.e. the portion of the characteristical curves indicated at X in FIG. 3, although it remains useful for the whole lifetime.

Figure 6:
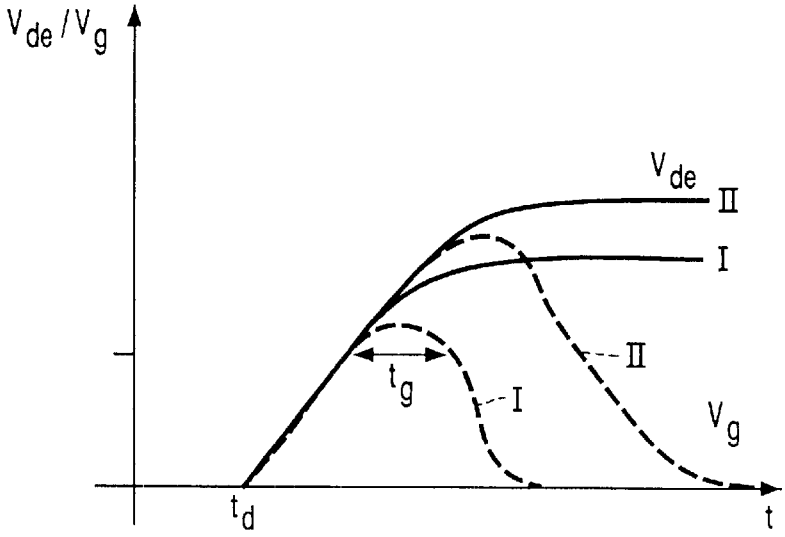
FIG. 6 is a graph illustrating an effect in operation of a pixel in the device of FIG. 5.

FIG. 6 shows graphically the variation of the gate voltage Vg of the feedback TFT 45 against time, t, in relation to the display element anode voltage characteristic $V_{de}$ of the display element in its charging period in a driving phase, beginning at a time td, immediately following an addressing phase. As in FIG. 3, the two sets of curves, I and II, illustrate these relationships at an initial stage in the display element's life and after, say, a few thousand hours operation respectively. With the high pass filter circuit suitably tuned, then the gate voltage Vg curves correspond roughly to the passive differential of the potential difference level, Vde. Vth is the threshold voltage of the TFT 45 and as can be seen, the magnitude of the gate voltage of TFT 45 is increased in accordance with the increase in the display element anode voltage over time and the duration, tg, for which this voltage exceeds the TFT threshold voltage Vth is also increased slightly.

Each row of pixels is addressed in the aforementioned manner in turn during respective address periods (as indicated by the relative timings of the selection signals, Vs, shown in FIG. 5) with the light outputs of their pixels adjusted as appropriate by operation of their feedback circuits and maintained until they are addressed again in a subsequent field.

The pixel circuit active matrix elements can all readily be fabricated as thin film components (TFTs, capacitors and conductive interconnections) on an insulating substrate. Likewise, the additional components of the potential sensing and feedback circuit, namely the additional TFTs 40 and 45 capacitor 47 and resistance 48, can be fabricated on the substrate at the same time using the same processes, the resistance for example comprising doped polysilicon in the case of the TFTs being polysilicon type TFTs. Alternatively, amorphous silicon technology could be used.

The TFTs in the above described embodiment comprise n and p channel MOS TFTs. Opposite types could be used instead, with the polarity of the display element 20 being reversed and the polarity of the drive voltage also be reversed, i.e. with the selection signals Vs comprising positive voltage pulses.

Although the current lines 32 in the above embodiment extend in the row direction and are shared by respective rows of pixels, they may instead extend in the column direction with each current line then being shared by a respective column of pixels.

The invention can be used also in EL display devices of the kind using current drive (data) signals rather than voltage drive signals as in the above-described embodiment. An example of such a device is described in WO99/65012 to which reference is invited. In the arrangement described therein, each pixel includes two additional TFTs interconnected between the gate node of the drive TFT 22, the line 32 and the output of the address TFT 26 which form a current—mirror circuit. The operation of the current—mirror circuit overcomes problems in the pixels of the array due to variations in the threshold voltages of the drive TFTs 22. In this device a pixel input, data, current flowing in the column conductor 14 is sampled via the TFT 26 and mirrored by the drive TFT to produce a proportional current through the display element. Once the current stabilises the voltage across the storage capacitor becomes equal to the gate voltage on the drive TFT 22 required to produce this current. The feedback circuit constituted by the components 45, 47 and 48 can similarly be used to adjust the stored voltage in the drive period as previously described.

Thus, in summary, an active matrix EL display device has been described in which the drive current through an EL display element in each pixel in a drive period is controlled by a driving device based on a drive signal applied to the pixel in preceding address period and stored as a voltage on an associated storage capacitor. In order to counteract the effects of display element ageing through which the light output of an element for a given drive signal level diminishes over time, the pixel includes a feedback circuit responsive to the potential difference across the display element in an initial part of the drive period indicative of the extent of ageing and which is arranged to adjust the voltage stored on the storage capacitance accordingly.

From reading the present disclosure, other modifications will be apparent to persons skilled in the art. Such modifications may involve other features which are already known in the field of active matrix electroluminescent display devices and component parts thereof and which may be used instead of or in addition to features already described herein.

What is claimed is:

1. An active matrix electroluminescent display device comprising an array of display pixels each comprising an electroluminescent display element and a driving device for controlling the current through the display element in a drive period based on a drive signal applied to the pixel during a preceding address period and stored as a voltage on a storage capacitance connected to the driving device, characterised in that each pixel includes feedback adjustment means responsive to the potential difference across the display element in the drive period and arranged to adjust the voltage stored on the storage capacitance in the address period in accordance therewith.

2. An active matrix electroluminescent display device according to claim 1, characterised in that the pixel includes a switching device operable to prevent electrical current flowing through the display element during the address period and allow drive current to flow through the display element in the drive period.

3. An active matrix electroluminescent display device according to claim 1, characterised in that the feedback adjustment means is responsive to the transient potential difference increase across the display element at the beginning of the drive period.

4. An active matrix electroluminescent display device according to claim 1, characterised in that said feedback adjustment means comprises a high pass filter circuit connected to the display element and responsive to the rise in voltage across the display element immediately following the address period to provide an output in accordance therewith which output controls the adjustment of the voltage stored on the storage capacitance.

5. An active matrix electroluminescent display device according to claim 4, characterised in that the output of the high pass filter controls a further switching device connected between the storage capacitance and a predetermined potential and operable by said output to provide supplemental charging of the storage capacitor.

* * * * *